US006508637B2

(12) United States Patent
Ohashi

(10) Patent No.: US 6,508,637 B2
(45) Date of Patent: Jan. 21, 2003

(54) AIR COMPRESSOR

(75) Inventor: Masakazu Ohashi, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 66 days.

(21) Appl. No.: 09/768,263

(22) Filed: Jan. 25, 2001

(65) Prior Publication Data

US 2001/0022942 A1 Sep. 20, 2001

(30) Foreign Application Priority Data

Jan. 26, 2000 (JP) ..... 2000-017439

(51) Int. Cl.[7] ..... F04B 39/00; F04B 53/00
(52) U.S. Cl. ..... 417/454; 417/312
(58) Field of Search ..... 417/312, 415, 417/222.2, 571, 454, 559, 567, 569

(56) References Cited

U.S. PATENT DOCUMENTS 4,304,534 A * 12/1981 Meise et al. ..... 417/569
4,470,774 A * 9/1984 Chambers ..... 417/567
4,616,983 A * 10/1986 Hanafi ..... 417/571
4,661,050 A * 4/1987 Deminski ..... 417/454
4,758,135 A * 7/1988 Woodward et al. ..... 417/559
4,768,933 A * 9/1988 Stachowiak ..... 417/454
4,960,368 A * 10/1990 Lillie ..... 417/312
5,022,833 A * 6/1991 Kandpal et al. ..... 417/571
5,051,067 A * 9/1991 Terauchi ..... 417/222.2
RE33,902 E * 4/1992 Fritchman ..... 417/312
5,102,312 A * 4/1992 Harvey ..... 417/571
5,816,783 A * 10/1998 Oshima et al. ..... 417/415

FOREIGN PATENT DOCUMENTS

JP 9-250507 9/1997

* cited by examiner

*Primary Examiner*—Teresa Walberg
*Assistant Examiner*—Leonid M Fastovsky
(74) *Attorney, Agent, or Firm*—Burns, Doane, Swecker & Mathis, LLP

(57) ABSTRACT

An air compressor includes a cylinder head in which is disposed a suction valve and a discharge valve, a cylinder having an opening edge closed by the cylinder head, a piston slidably inserted in the cylinder and forming a variable volume chamber with the cylinder head, and a driving device for driving the piston in a reciprocating manner. The cylinder head includes a plate forming valve seats and ports of the suction valve and the discharge valve, and a housing accommodating the suction valve, the discharge valve and the plate. The plate is fixed against the cylinder by a fixing member engaged with the housing.

19 Claims, 6 Drawing Sheets

AIR COMPRESSOR

This application is based on and claims priority under 35 U.S.C. §119 with respect to Japanese Application No. 2000-017439 filed on Jan. 26, 2000, the entire content of which is incorporated herein by reference.

FIELD OF THE INVENTION

The present invention generally relates to an air compressor. More particularly, the present invention pertains to an air compressor of the air pressure type that is used in a vehicular height adjusting device.

BACKGROUND OF THE INVENTION

A known air compressor is disclosed in, for example, Japanese Patent Laid-Open Publication No. Hei 9-250507 published on Sep. 22, 1997. This air compressor includes a cylinder head comprised of a housing and a cover plate. The housing forms the valve seats of a suction valve and a discharge valve, and accommodates the suction valve and the discharge valve. The cover plate closes an upper opening edge of the housing. The housing is fixed against the cylinder by a fixing member which engages the cover plate so as to touch an opening edge of the cylinder.

In the above-mentioned air compressor, it is necessary to exchange or use a different housing to change the structure of the suction valve, to change the opening-pressure of the discharge valve or to change the characteristic of the air compressor by tuning the diameters of the suction port of the suction valve and the discharge port of the discharge valve. However, from a cost standpoint, this is quite undesirable because the housing is generally the largest member amongst the various members forming the cylinder head and is relatively expensive.

In light of the foregoing, a need exists for an air compressor which allows various aspects of the compressor such as those mentioned above to be changed in a relatively cost-effective manner.

SUMMARY OF THE INVENTION

One aspect of the present invention involves an air compressor that includes a cylinder head accommodating a suction valve and a discharge valve, a cylinder having an open end closed by the cylinder head, a piston slidably positioned within the cylinder and forming a variable volume chamber with the cylinder head, and a driving device for driving the piston in a reciprocating manner. The cylinder head includes a plate forming a valve seat and a suction port of the suction valve, and a valve seat and a discharge port of the discharge valve. The cylinder head also includes a housing accommodating the suction valve, the discharge valve and the plate, with the plate being fixed against the cylinder by a fixing member so that the plate confronts the opening end of the cylinder.

This construction of the air compressor is quite advantageous from the standpoint of cost because the housing does not need to be exchanged to change the structure of the suction valve, to change the opening-pressure of the discharge valve or to change the characteristic of the air compressor by tuning the diameters of the suction port of the suction valve and the discharge port of the discharge valve. Rather, with the present invention, these changes can be accomplished by exchanging the plate which forms a much smaller and less expensive part of the cylinder head.

According to another aspect of the present invention, an air compressor includes a housing and a plate forming a cylinder head, with the plate being provided with a suction port forming part of a suction valve and a discharge port forming part of a discharge valve. A cylinder has an open end that is closed by the cylinder head. A first seal member is positioned to provide a seal between the plate and the housing while a second seal member is positioned to provide a seal between the plate and the cylinder. A fixing member fixes the cylinder head to the cylinder. A piston is slidably positioned in the cylinder and forms a variable volume chamber with the cylinder head, and a driving device is operatively connected to the piston to drive the piston in a reciprocating manner.

In accordance with another aspect of the invention, an air compressor includes a housing and a plate forming a cylinder head, with the plate being provided with a suction port and a suction valve seat, and being provided with a discharge port and a discharge valve seat. A suction valve member is accommodated on the plate and is positionable in engagement with the suction valve seat to close the suction port and is movable out of engagement with the suction valve seat to open the suction port. A discharge valve member is positioned within the cylinder head and is positionable in engagement with the discharge valve seat to close the discharge port and is movable out of engagement with the discharge valve seat to open the discharge port. A cylinder has an open end that is closed by the cylinder head and a fixing member fixes the cylinder head to the cylinder. A piston is slidably positioned in the cylinder and forms a variable volume chamber with the cylinder head. A driving device is operatively connected to the piston to move the piston within the cylinder.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

Figure 1:
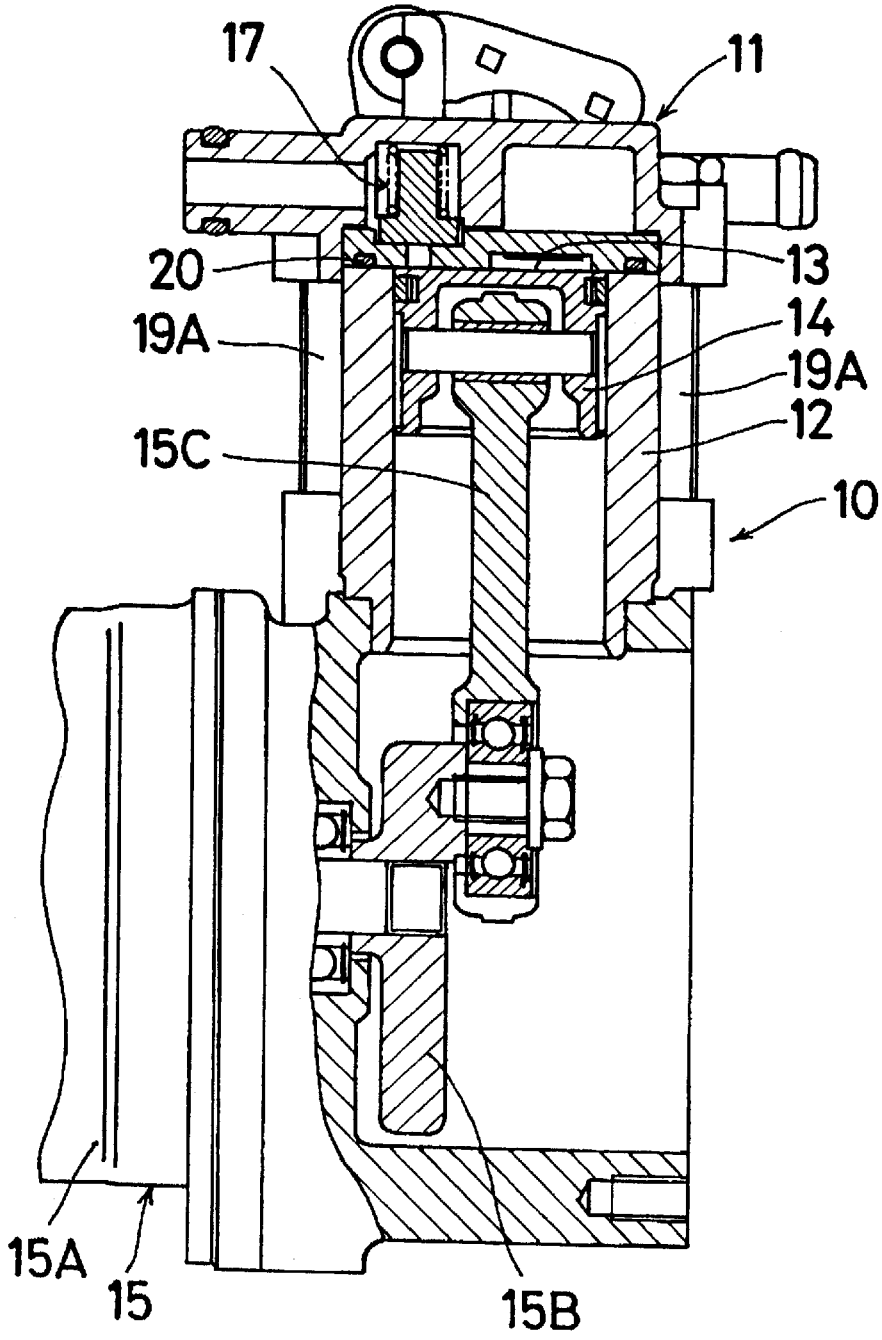
FIG. 1 is a vertical cross-sectional view of an air compressor according to one embodiment of the present invention.
Figure 2:
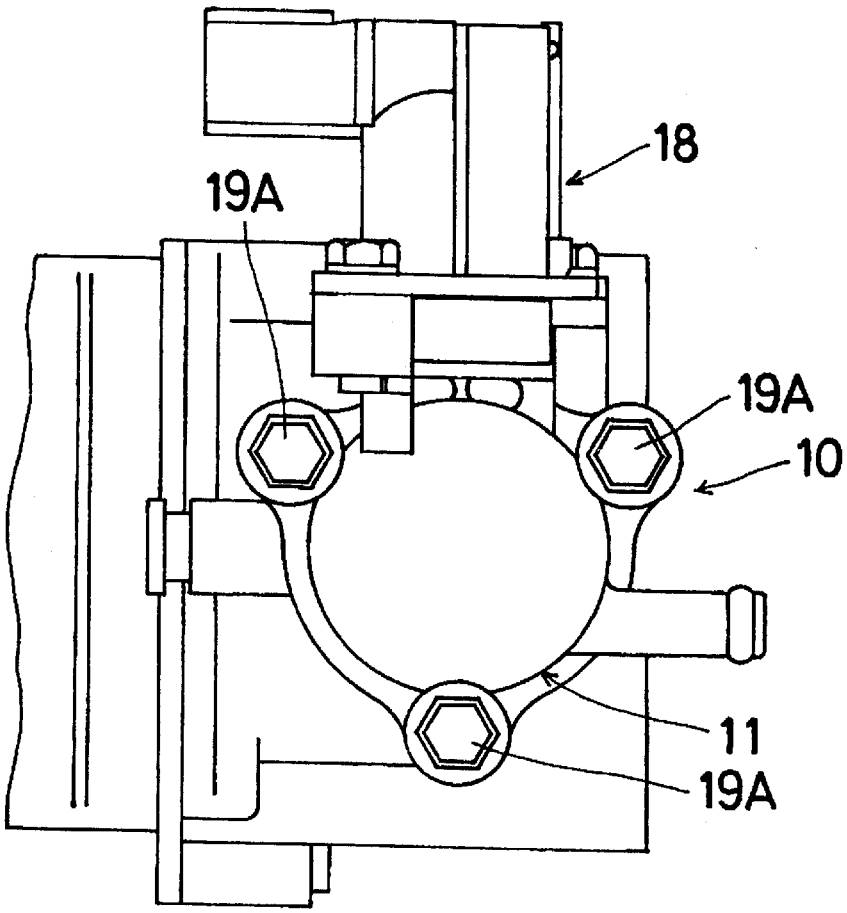
FIG. 2 is a top view of the air compressor shown in FIG. 1.
Figure 3:
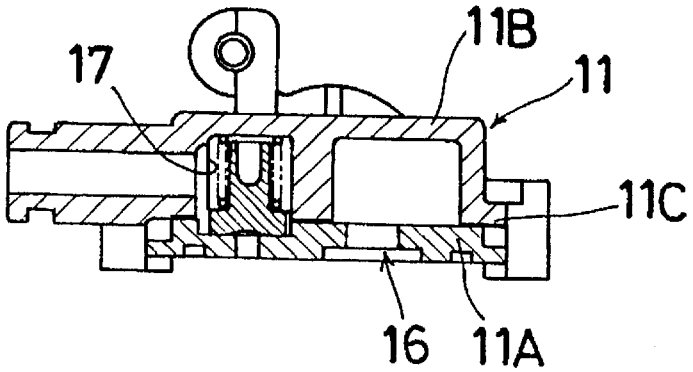
FIG. 3 is a vertical cross-sectional view of the cylinder head forming a part of the air compressor shown in FIG. 1.

Referring initially to FIGS. 1–3, the air compressor according to the present invention includes a cylinder head 11 in which is disposed a suction valve 16, a discharge valve 17 and a solenoid 18 which releases the compressed air, a cylinder 12 which has an opening edge or open end closed by the cylinder head 11, a piston 14 which is slidably inserted in the cylinder 12 and forms a variable volume chamber 13 with the cylinder head 11, and a driving device 15 which drives the piston 14 in a reciprocating manner.

The driving device 15 includes a motor 15A, a rotating member 15B operatively associated with the motor 15A, and a connecting rod 15C. The upper edge or end of the connecting rod 15C is connected with the piston 14 and the bottom edge or end of the connecting rod 15C is connected with the rotating member 15B at a point radially spaced from the central axis of the rotating member 15B.

As best seen in FIG. 3, the cylinder head 11 includes a plate 11A, a housing 11B which accommodates the plate 11A, the suction valve 16, the discharge valve 17, and a seal member 11C fixed between the plate 11A and the housing 11B. The plate 11A is fixed against the cylinder 12 by a fixing member which may be in the form of a plurality of removable bolts 19A (e.g., three bolts) which engage the housing of the motor 15A while penetrating an outer flange of the housing 11B. The plate 11A thus confronts the opening edge of the cylinder 12. It is to be understood that the number of bolts 19A may be varied and is not restricted to the three illustrated in FIG. 2.

Figure 4:
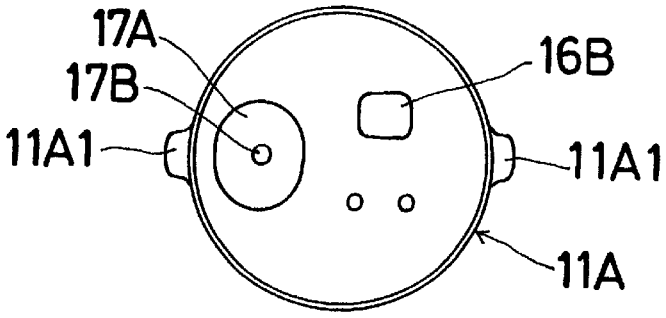
FIG. 4 is a top view of the plate used in the cylinder head illustrated in FIG. 3.
Figure 5:
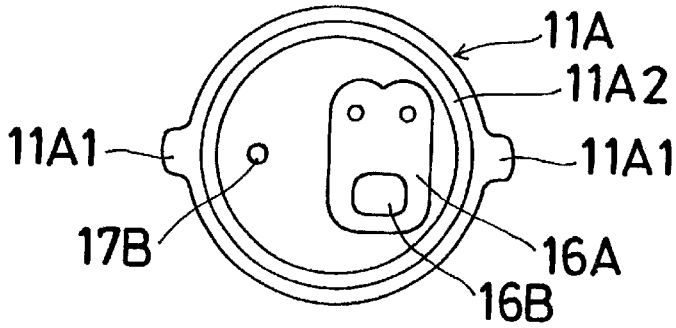
FIG. 5 is a bottom view of the plate shown in FIG. 4.

As shown in FIG. 4 and FIG. 5, the plate 11A is generally circular or disk-shaped and is preferably made of metal. The plate 11A forms a valve seat 16A and a suction port 16B of the suction valve 16 as well as a valve seat 17A and a discharge port 17B of the discharge valve 17. Two radially outwardly extending protrusions 11A1 are provided on the outer surface of the plate 11A. In the illustrated embodiment, the protrusions 11A1 are positioned at diametrically opposite positions on the plate 11A. In addition, the plate 11A is provided with a ring-shaped groove 11A2 that receives a ring-shaped seal member 20 which confronts and contacts the upper edge of the cylinder 12. The seal member 20 provides a seal between the plate 11A and the cylinder 12 when the bolts 19A are secured in place.

Figure 6:
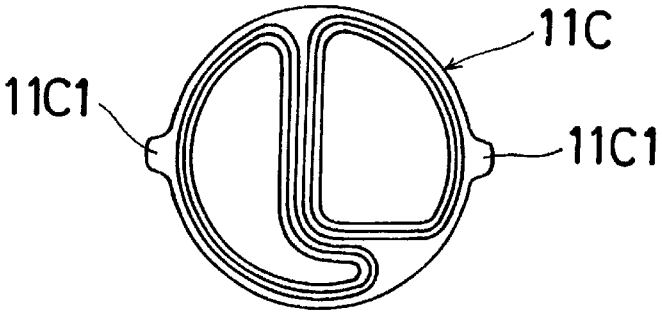
FIG. 6 is a bottom view of the seal member used in the cylinder head illustrated in FIG. 3.

As shown in FIG. 3 and FIG. 6, the seal member 11C is generally ring-shaped and is provided with two radially outwardly extending protrusions 11C1 on its outer surface. In the illustrated embodiment, the protrusions 11C1 are positioned at diametrically opposite positions on the seal member 11C. The seal member 11C forms a seal between the plate 11A and the housing 11B when the bolts 19A are secured in place.

Figure 7:
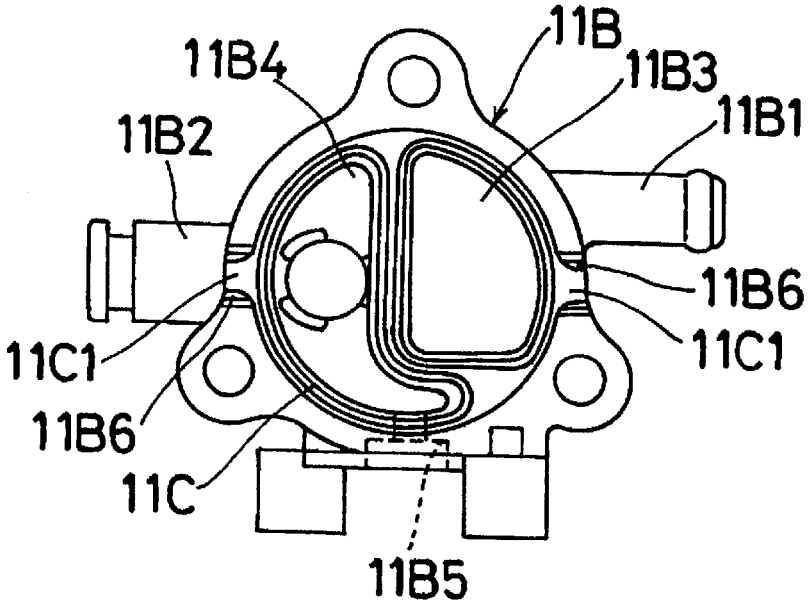
FIG. 7 is a bottom view of the housing accommodating the seal member depicted in FIG. 6.

As shown in FIG. 7, the housing 11B has a suction pipe 11B1, a discharge pipe 11B2, a chamber 11B3 communicating with the suction pipe 11B1 and the suction port 16B, a chamber 11B4 communicating with the discharge pipe 11B2 and accommodating the discharge valve 17, and a port 11B5 communicating with the chamber 11B4 for releasing the compressed air. This port 11B5 is selectively opened or closed by the solenoid 18.

The housing 11B also has two recesses 11B6 which receive and are engaged by the protrusions 11C1 of the seal member 11C. The recesses 11B6 and the protrusions 11C1 thus form engaging portions that engage one another, with the engagement between the protrusions 11C1 and the recesses 11B6 fixing the circumferential position of the housing 11B and the seal member 11C relative to one another.

It is to be understood that the seal member 11C may also be attached to the plate 11A by baking the rubber material forming the seal member. In this case, the protrusions 11C1 on the seal member 11C can be omitted.

Figure 8:
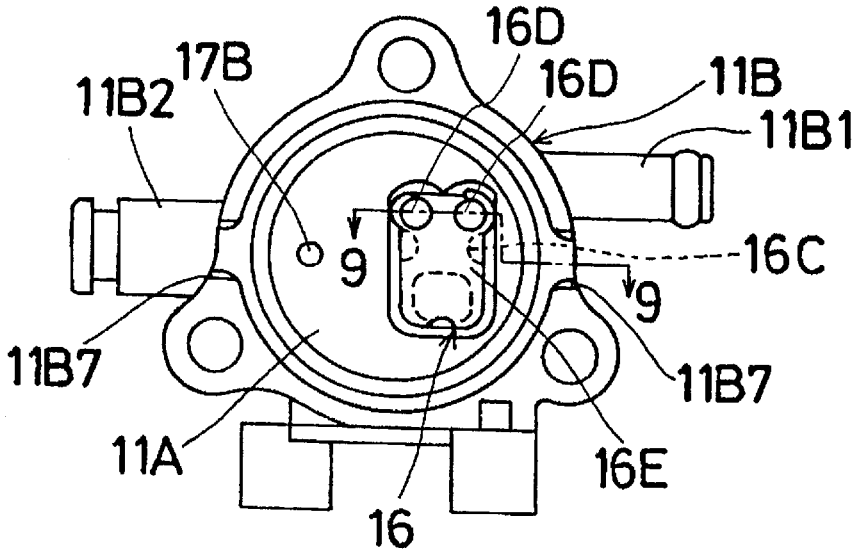
FIG. 8 is a bottom view of the cylinder head used in the air compressor shown in FIG. 1.

FIG. 8 illustrates that the housing 11B is provided with two recesses 11B7 which receive and are engaged by the protrusions 11A1 of the plate 11A. The recesses 11B7 and the protrusions 11A1 thus form engaging portions that engage one another, with the engagement between the protrusions 11A1 and the recesses 11B7 fixing the circumferential position of the plate 11A and the housing 11B relative to one another.

Figure 9:
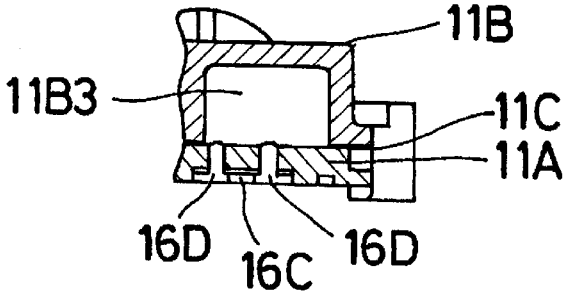
FIG. 9 is a cross-section view of the cylinder head taken along the section line 9—9 of FIG. 8.

As shown in FIGS. 8 and 9, the suction valve 16 includes a tongue-shaped suction valve member 16C forming a leaf spring and a guide 16E which restricts lifting of the valve 16C. One end of the suction valve member 16C and the guide 16E are fixed on the plate 11A by two pins 16D. The suction valve member 16C contacts the valve seat 16A to close the suction port 16B in the case of positive pressure in the variable volume chamber 13 and is detached from or moved out of contact with the valve seat 16A to open the suction port 16B in the case of negative pressure in the variable volume chamber 13. In this way, the suction valve 16 is generally constructed as a reed valve.

Figure 10:
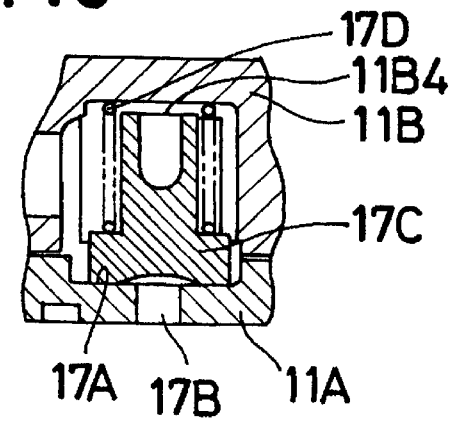
FIG. 10 is an enlarged view of the discharge valve of the cylinder head shown in FIG. 3.
Figure 11:
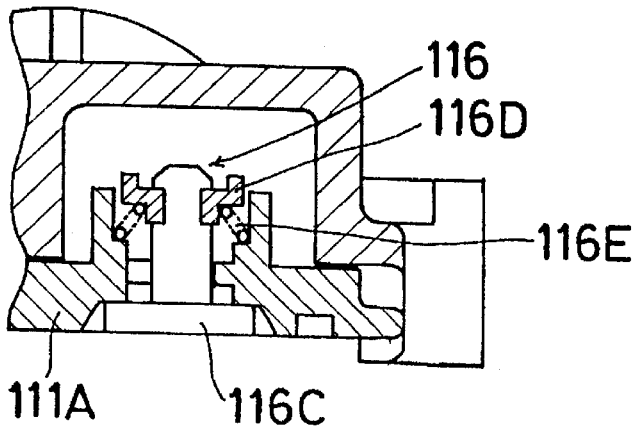
FIG. 11 is a cross-section view of the cylinder head according to a second embodiment of the present invention.
Figure 12:
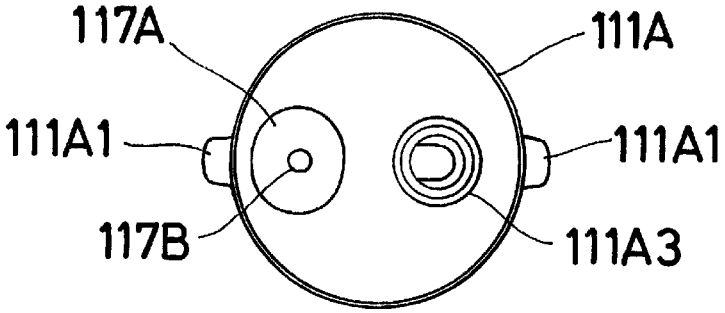
FIG. 12 is top view of a second embodiment of a plate used in the cylinder head.
Figure 13:
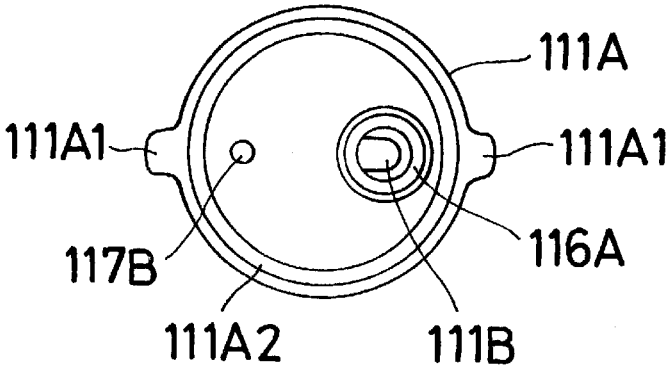
FIG. 13 is bottom view of the plate shown in FIG. 12.
Figure 14:
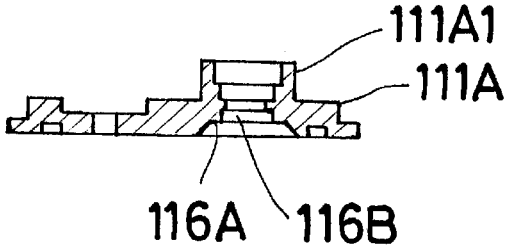
FIG. 14 is a cross-sectional view of the plate according to the second embodiment of the present invention.

Referring to FIG. 10, the discharge valve 17 includes a valve seat 17A, a discharge valve member 17C and a spring 17D which is held between the valve 17C and the housing 11B to push the discharge valve member 17C toward the valve seat 17A. The discharge valve member 17C contacts the valve seat 17A to close the discharge port 17B under the load or urging force of the spring 17D and is detached or moved away from the valve seat 17A to open the discharge port 17B in the case of positive pressure in the variable volume chamber 13. In this way, the discharge valve 17 is generally constructed as a poppet valve.

The operation of the air compressor 10 according to the present invention is the same as the operation of other known air compressors such as that described above. Thus, a detailed explanation of the operation of the air compressor is not included here as such operation is known to persons skilled in the art. In the air compressor 10 according to the present invention, the load of the spring 17D changes depending on the height of the valve seat 17A of the plate 11A of the cylinder head 11 (i.e., the distance between the valve seat 17A and the upper surface of the plate 11A in FIG. 10). Therefore, it is only necessary to change or exchange the plate 11A in order to change the opening-pressure of the discharge valve 17, as well as the characteristics of the air compressor 10 by tuning the diameters of the suction port 16B or the discharge port 17B which are formed on the plate 11A. From a cost perspective, it is much more desirable to exchange or change the plate 11A than it is to exchange the housing 11B because the plate 11A is significantly smaller than the housing 11B. Moreover, the housing 11B can be made of resin. In this regard, the air compressor 10 of the present invention is favorable not only from the standpoint of cost but also from the standpoint of weight.

Referring to FIGS. 11–14, a suction valve 116 according to a second embodiment of the present invention includes a valve seat 116A formed on a plate 111A, a suction port 111B formed on the plate 111A, a valve 116C, and a spring 116E held between a retainer 116D disposed on the valve 116C and the plate 111A. The plate 111A possesses a cylindrical portion 111A3 accommodating the retainer 116D and the spring 116E. Also the plate 111A is provided with a valve seat 117A and a discharge port 117B of the discharge valve, two radially outwardly directed protrusions 111A1 and a groove 111A2. If the plate 111A assembled with this suction valve 116 is formed so as to be compatible with the plate 11A according to the first embodiment of the present invention described above, it is only necessary to exchange the plate, even when the structure of the suction port is changed. This is favorable from the standpoint of cost.

As mentioned above, the air compressor according to the present invention is considerably more favorable from the standpoint of cost as compared to other known constructions such as that described above because the housing which is the largest member forming the cylinder head does not need to be exchanged. Rather, only the plate needs to be exchanged in order to change the structure of the suction valve, to change the opening-pressure of the discharge valve or to change the characteristic of the air compressor by tuning the diameters of the suction port of the suction valve and the discharge port of the discharge valve.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An air compressor comprising:

a housing and a plate forming a cylinder head, the plate being provided with a suction port forming part of a suction valve and a discharge port forming part of a discharge valve;

a first seal member positioned to provide a seal between the plate and the housing;

a cylinder having an open end closed by the cylinder head;

a second seal member positioned to provide a seal between the plate and the cylinder;

a fixing member fixing the cylinder head to the cylinder;

a piston slidably positioned in the cylinder and forming a variable volume chamber with the cylinder head; and a driving device operatively connected to the piston to drive the piston in a reciprocating manner.

2. The air compressor according to claim 1, including a suction valve member secured to the plate and forming part of the suction valve.

3. The air compressor according to claim 1, wherein the plate includes a suction valve seat forming part of the suction valve and a discharge valve seat forming part of the discharge valve.

4. The air compressor according to claim 3, including a discharge valve member positioned between the housing and the plate and forming part of the discharge valve, a spring engaging the discharge valve member and urging the discharge valve member towards the discharge valve seat in the plate.

5. The air compressor according to claim 1, wherein the plate and the housing include engaging portions that engage one another to fix the circumferential position of the plate and the housing relative to one another.

6. The air compressor according to claim 1, wherein the first seal member is disposed in a groove formed in one of the plate and the housing.

7. The air compressor according to claim 1, wherein the first seal member and the housing include engaging portions that engage one another to fix the circumferential position of the first seal member and the housing relative to one another.

8. An air compressor comprising:

a housing and a plate forming a cylinder head, the plate being provided with a suction port and a suction valve seat, the plate being provided with a discharge port and a discharge valve seat;

a suction valve member accommodated on the plate and positionable in engagement with the suction valve seat to close the suction port and movable out of engagement with the suction valve seat to open the suction port;

a discharge valve member positioned within the cylinder head and positionable in engagement with the discharge valve seat to close the discharge port and movable out of engagement with the discharge valve seat to open the discharge port;

a cylinder having an open end closed by the cylinder head;

a fixing member fixing the cylinder head to the cylinder;

a piston slidably positioned in the cylinder and forming a variable volume chamber with the cylinder head; and a driving device operatively connected to the piston to move the piston within the cylinder.

9. The air compressor according to claim 8, including a seal member positioned between the plate and the housing.

10. The air compressor according to claim 9, wherein the seal member and the housing include engaging portions that engage one another to fix the circumferential position of the seal member and the housing relative to one another.

11. The air compressor according to claim 8, including a seal member positioned between the plate and the cylinder.

12. The air compressor according to claim 8, including a spring engaging the discharge valve member and urging the discharge valve member towards the discharge valve seat in the plate.

13. The air compressor according to claim 8, wherein the plate and the housing include engaging portions that engage one another to fix the circumferential position of the plate and the housing relative to one another.

14. An air compressor comprising:

a cylinder head accommodating a suction valve and a discharge valve;

a cylinder having an open edge closed by the cylinder head;

a piston slidably positioned in the cylinder and forming a variable volume chamber with the cylinder head; and a driving device operatively connected to the piston to drive the piston in a reciprocating manner;

the cylinder head including a plate forming a valve seat and a suction port of the suction valve, and also forming a valve seat and a discharge port of the discharge valve, the cylinder head also including a housing accommodating the suction valve, the discharge valve and the plate, the plate being fixed against the cylinder by a fixing member so that the plate confronts the open edge of the cylinder.

15. The air compressor according to claim 14, wherein the suction valve is assembled on the plate.

16. The air compressor according to claim 14, wherein the plate and the housing include engaging portions that engage one another to fix the circumferential position of the plate and the housing relative to one another.

17. The air compressor according to claim 14, including a seal member disposed between the plate and the housing and fixed by the fixing member.

18. The air compressor according to claim 14, wherein the plate and the housing are separate from each other, and including a seal member fixed between the plate and the housing by the fixing member, the plate, the seal member and the housing being provided with engaging portions that engage one another to fix the circumferential positions of the plate, the seal member and the housing relative to one another.

19. The air compressor according to claim 14, wherein the plate is made of metal and the housing is made of resin.

* * * * *